US011355862B1

(12) United States Patent
Niemczyk et al.

(10) Patent No.: US 11,355,862 B1
(45) Date of Patent: Jun. 7, 2022

(54) RUGGEDIZED ANTENNAS AND SYSTEMS AND METHODS THEREOF

(71) Applicant: Lockheed Martin Corporation, Bethesda, MD (US)

(72) Inventors: Anthony R. Niemczyk, Southampton, NJ (US); Robert Korey Shaw, Cinnaminson, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 221 days.

(21) Appl. No.: 16/706,089

(22) Filed: Dec. 6, 2019

(51) Int. Cl.
*H01Q 21/06* (2006.01)
*H01Q 9/04* (2006.01)
*H01Q 1/40* (2006.01)

(52) U.S. Cl.
CPC ..... *H01Q 21/065* (2013.01); *H01Q 1/405* (2013.01); *H01Q 9/0414* (2013.01)

(58) Field of Classification Search
CPC ..... H01Q 1/405; H01Q 21/065; H01Q 9/0414
See application file for complete search history.

(56) References Cited

U.S. PATENT DOCUMENTS 4,811,028 A * 3/1989 Bryanos ..... H01Q 13/0275 343/705
5,457,471 A 10/1995 Epperson, Jr.
5,872,542 A * 2/1999 Simons ..... H01Q 13/085 343/700 MS
6,480,168 B1 * 11/2002 Lam ..... H01Q 1/1235 343/805
7,450,071 B1 * 11/2008 Volman ..... H01Q 1/02 343/700 MS
7,498,989 B1 3/2009 Volman
8,085,203 B1 * 12/2011 Klein ..... H01Q 21/065 343/700 MS
2006/0205343 A1 * 9/2006 Runyon ..... H04B 7/15571 455/11.1
2006/0255948 A1 * 11/2006 Runyon ..... B66F 9/0755 340/572.7
2006/0255950 A1 * 11/2006 Roeder ..... B66F 9/12 340/572.7

(Continued)

FOREIGN PATENT DOCUMENTS

EP 0279050 A1 8/1988
EP 0886336 A2 12/1998

(Continued)

*Primary Examiner* — Lam T Mai
(74) *Attorney, Agent, or Firm* — Michael Best & Friedrich LLP

(57) ABSTRACT

An antenna includes at least one antenna element mounted on a substrate and extending normally thereto. The at least one antenna element is constructed from a plurality of antenna components, one of which is an upper antenna component that is furthest from the substrate. A support material surrounds the at least one antenna element and is disposed between the antenna components. A material layer is disposed on the upper antenna component and the support material. Heating elements may be interposed between the upper antenna component and the material layer, and an additional material layer, such as an ablative layer, may be disposed on the material layer.

19 Claims, 7 Drawing Sheets

(56) References Cited

U.S. PATENT DOCUMENTS

| | | | | |
|---|---|---|---|---|
| 2007/0205946 | A1* | 9/2007 | Buris | H01Q 9/0407 343/700 MS |
| 2007/0216587 | A1* | 9/2007 | Schmidt | H01Q 9/0407 343/711 |
| 2010/0090906 | A1* | 4/2010 | McGuire | H05K 7/1462 343/702 |
| 2010/0109964 | A1* | 5/2010 | Eom | H01Q 21/065 343/793 |
| 2012/0313823 | A1* | 12/2012 | Armstrong | H01Q 25/001 343/700 MS |
| 2017/0234929 | A1* | 8/2017 | Vinson | H02P 29/0241 324/765.01 |
| 2020/0044326 | A1* | 2/2020 | Olfert | H01Q 1/364 |
| 2020/0259269 | A1* | 8/2020 | Kim | H01Q 19/24 |
| 2020/0266549 | A1* | 8/2020 | Yamamoto | H01Q 9/0407 |
| 2020/0303813 | A1* | 9/2020 | Morimoto | H01Q 21/065 |
| 2020/0343618 | A1* | 10/2020 | Echi | H01Q 1/38 |
| 2020/0350667 | A1* | 11/2020 | Echi | H05K 1/0284 |
| 2021/0066814 | A1* | 3/2021 | Kim | H01Q 9/0414 |

FOREIGN PATENT DOCUMENTS

| | | | |
|---|---|---|---|
| EP | 1071161 | A1 | 1/2001 |
| FR | 2423876 | A1 | 11/1979 |

* cited by examiner

RUGGEDIZED ANTENNAS AND SYSTEMS AND METHODS THEREOF

BACKGROUND

The present disclosure relates to radio antennas, such as those used in radar, telecommunications, and other radio disciplines. Particularly, the present disclosure discusses issues of antenna operability that arise in harsh, or even extreme operating environments. Seaborne radar is an apt example; a seaborne radar antenna must operate in wet, high-saline environmental conditions that are unlike those encountered on dry land. Inclement weather events, e.g., hail storms, can render an antenna inoperable at a time when such operability is most vital, such as for weather radar and emergency communications. Certain antennas must also meet the rigorous demands of military conflict—engaging everything from flying debris to the thermal blast of a nuclear explosion. One technique to protect antennas against such conditions is to deploy a radome, which, as the term is used herein, can refer to an intervening structure between the antenna and its external environment into which radio waves are transmitted from the antenna and from which radio waves are received by the antenna. It is typical of radomes to be constructed of a radio-transparent material, but it is also typical to model and/or measure radome effects and to include such in radio calibration data. It is an engineering challenge in radome design to realize a structure that offers suitable protection while minimizing the radio (and mechanical) footprint of that protection.

Antennas in certain applications, such as radar and telecommunications, comprise complex structures that may raise further antenna protection concerns. FIG. 1 is a schematic diagram of an array antenna tile 10 that might be used in a radio-frequency (RF) application such as radar. Typically, a complete array antenna is constructed from several such antenna tiles mounted on a suitable support frame. Antenna tile 10 has a plurality of antenna elements 100 distributed over its face. The final antenna array comprises multiple such antenna elements 100 suitably spaced one from the other to meet a designed radiation pattern. Antenna tile 10 includes a rigid support backing or baseplate 150 to which is also attached a circuit board 160 containing antenna feed, processing, and control circuitry.

Example antenna element 100 is a stacked patch antenna comprising a lower antenna component, e.g., lower patch 120, and an upper antenna component, e.g., upper patch 110 situated over a ground plane (such as might be disposed over baseplate 150) and otherwise surrounded by air. In the illustrated implementation, lower patch 120 is coupled to transmit/receive circuitry (not illustrated in FIG. 1) at one or more terminals, representatively illustrated at terminals 122 and 124, while upper patch 110 is parasitic. Upper patch 110 is separated from lower patch 120 by stem 115, which also connects upper patch to ground. Example antenna element 100 is dielectrically loaded for miniaturization, such as by a dielectric disk 140, and is suitably positioned among grounded wings 130 that reduce coupling between adjacent antenna elements 100. Of course, the size of these structures is dependent on the frequency of the radio waves being considered. As such, the skilled artisan will acknowledge that, at finer scales corresponding to higher frequencies, certain of these structures become less tolerant to externally applied forces, such as mechanical shock and compression.

In certain implementations, antenna elements 100 and indeed the entire antenna is protected from inclement weather and other environmental factors by way of a stretched-fabric radome (not illustrated). However, conventional radomes, such as stretched-fabric radomes, fall short of the protection necessary for certain applications. Moreover, the formation of ice on such stretched-fabric radomes can interfere with radio signals and deicing these radomes involves complicated procedures.

SUMMARY

An antenna includes at least one antenna element mounted on a substrate and extending normally thereto. The at least one antenna element is constructed from a plurality of antenna components, one of which is an upper antenna component that is furthest from the substrate. A support material surrounds the at least one antenna element and is disposed between the antenna components. A material layer is disposed on the upper antenna component and the support material. Heating elements may be interposed between the upper antenna component and the material layer, and an additional material layer, such as an ablative layer, may be disposed on the material layer.

An array antenna constructed from a plurality of antenna tiles, each antenna tile comprising: a plurality of antenna elements distributed over a substrate and extending normally thereto, the antenna elements comprising respective antenna components, one of which is an upper antenna component that is furthest from the substrate; a support material surrounding the antenna elements and disposed between the antenna components; and a material layer disposed on the upper antenna components and the support material.

An array antenna comprising: a plurality of antenna elements distributed over a substrate and extending normally thereto, the antenna elements comprising respective antenna components, one of which is an upper antenna component that is furthest from the substrate; heating elements disposed on the respective upper antenna components of a set of the antenna elements; a support material surrounding the antenna elements and disposed between the antenna components; and a material layer disposed on the heating elements and the support material.

DETAILED DESCRIPTION

Principles of the present disclosure are directed to maintaining the structural integrity of various antenna systems in the presence of adverse environmental conditions. Practicing the principles described herein can involve installing mechanical mechanisms that bear on the efficiency with which electromagnetic signals are emitted and intercepted by the antenna. Certain figures herein, including FIG. 1 introduced above, depict generalized antenna structure that is not necessarily scaled or dimensioned for achieving the aforementioned electromagnetic efficiency. Electrical connections and structures may be omitted in certain figures. Nevertheless, skilled artisans can apply the inventive principles described herein to numerous antenna designs for which electromagnetic efficiency is fully considered based on the generalizations conveyed through the figures and the accompanying descriptions thereof.

Figure 2:
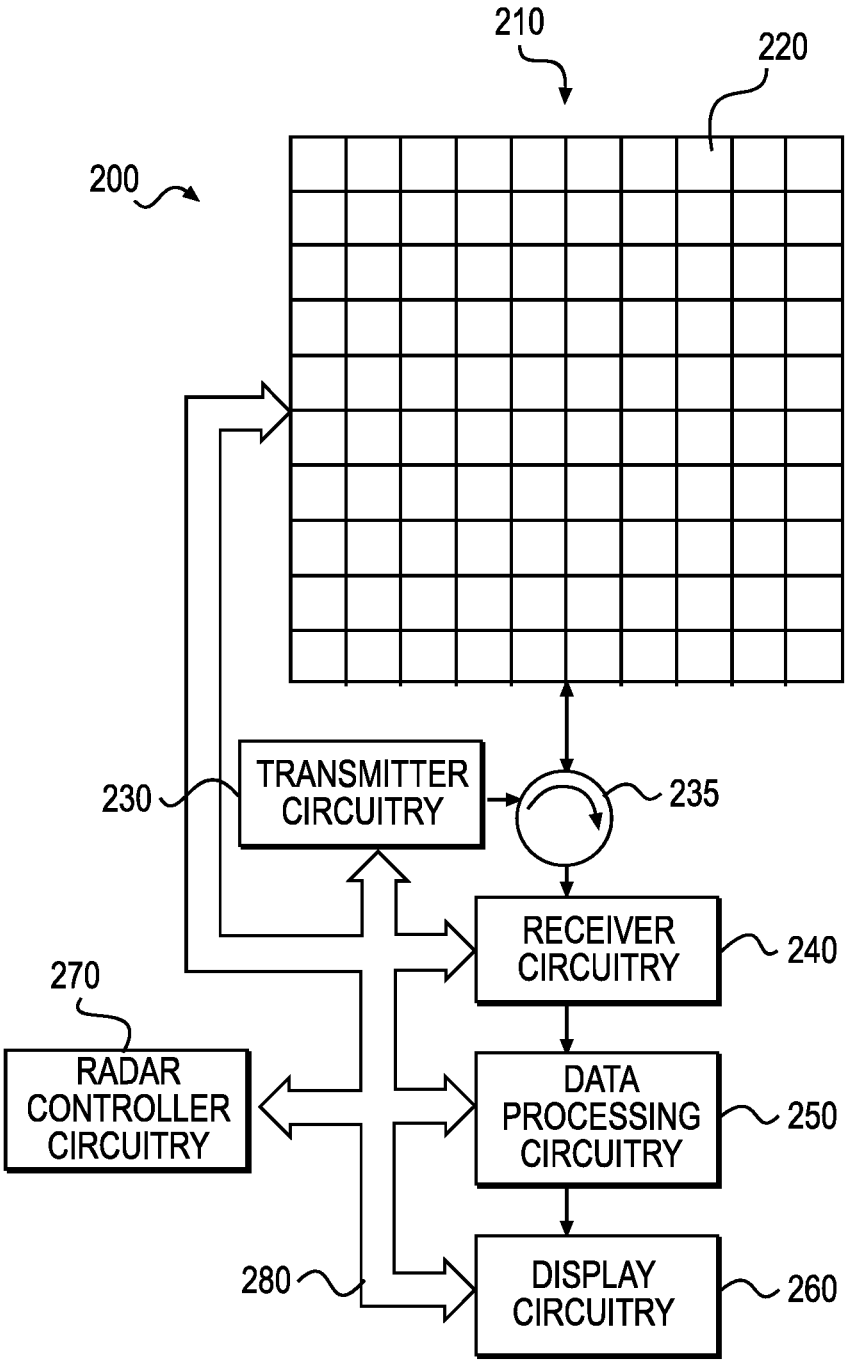
FIG. 2 is a schematic block diagram of an example radar system in which principles of the present disclosure can be applied.

FIG. 2 is a schematic block diagram of an example radar system 200 in which principles of the present disclosure can be applied. As illustrated in the figure, radar system 200 comprises an array antenna 210, transmitter circuitry 230, receiver circuitry 240, data processing circuitry 250, and display circuitry 260, each connected to radar controller circuitry 270 by a suitable control bus 280. Briefly, RF signals can be generated and modulated for transmission by transmitter circuitry 230. The RF signals provided to a circulator 235, or some other means for isolating the receiver from the strong transmit signals, can be transmitted in a beam defined by array antenna 210. RF return signals can be received through an aperture defined by array antenna 210 and provided to receiver circuitry 240, where they are downconverted and sampled to generate baseband return data. The baseband return data may be processed by data processing circuitry 250 to characterize the volume of space illuminated by the RF transmit signals, where such characterization can be visually displayed on display circuitry 260. Those skilled in radar will recognize how the components illustrated in FIG. 2 can be constructed and/or configured to realize a fully functional radar system without implementation details being set forth herein. A focus of this disclosure is on the construction of array antenna 210 and, as such, finer details of radar operation will be omitted in the interest of conciseness. Indeed, radar is merely an apt example of a system in which an array antenna might be used; the technique described herein finds applicability in other systems that use antennas, such as telecommunications.

Figure 1:
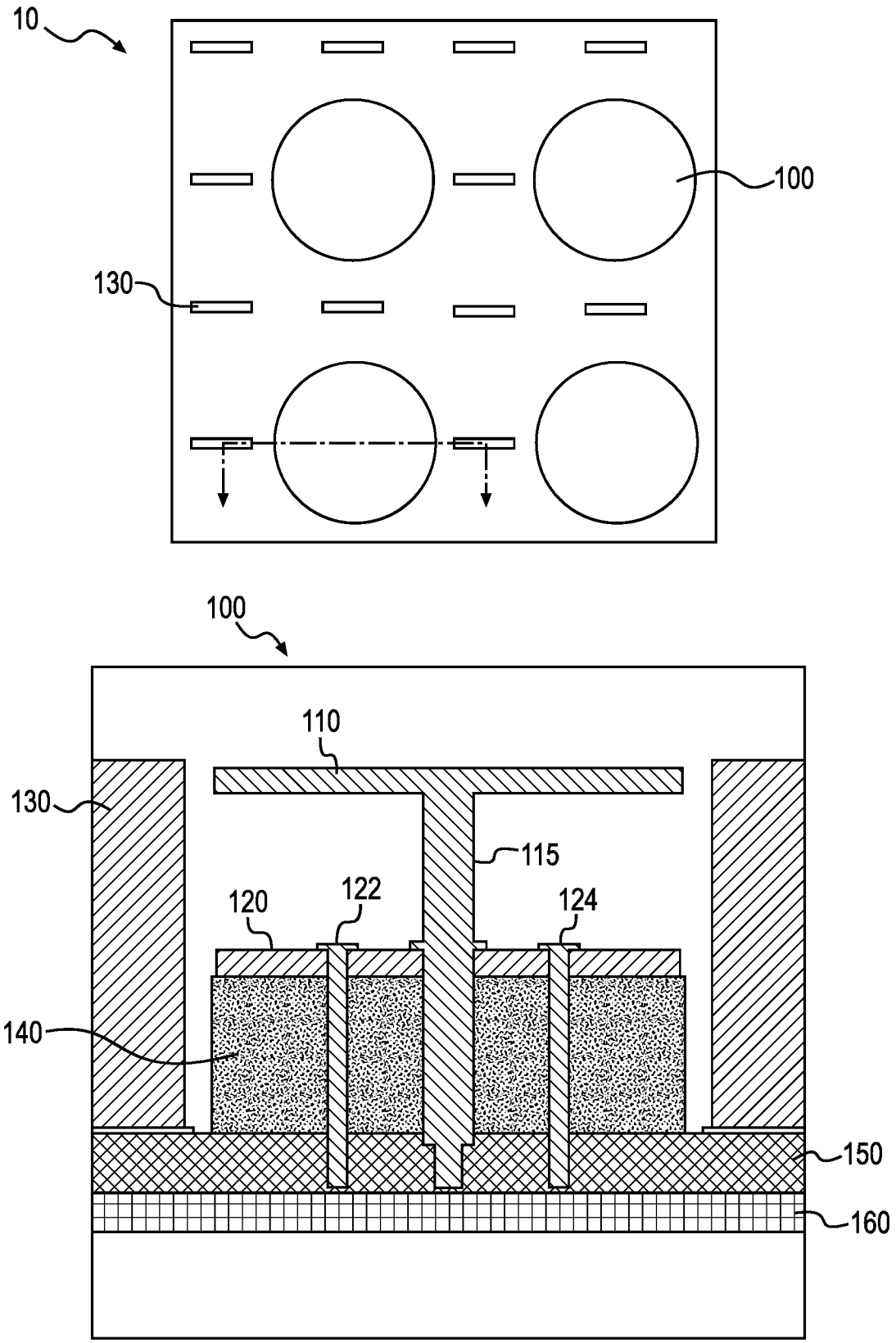
FIG. 1 is a diagram of an array antenna tile that might be used in a radio-frequency application such as radar.

Array antenna 210 may be constructed from a plurality of antenna tiles, representatively illustrated at antenna tile 220. For purposes of exemplification and not limitation, antenna tiles 220 may be constructed similarly to antenna tile 10 described above, but with features described herein added thereto. As such, like features of antenna tile 220 in FIG. 3 to those of antenna tile 10 in FIG. 1 are like-numbered. It is to be understood, however, that the techniques described herein can be applied to antenna structures other than that illustrated in FIG. 1, as the skilled artisan will appreciate upon review of this disclosure.

Antenna tiles 220 may be mechanically supported by a support frame (not illustrated in FIG. 2) that aligns antenna tiles 220 one with another so as to maintain spacing of antenna elements 100 across array antenna 210. The concepts described herein are not limited to particular support structures, the construction of which will vary by application.

Figure 3:
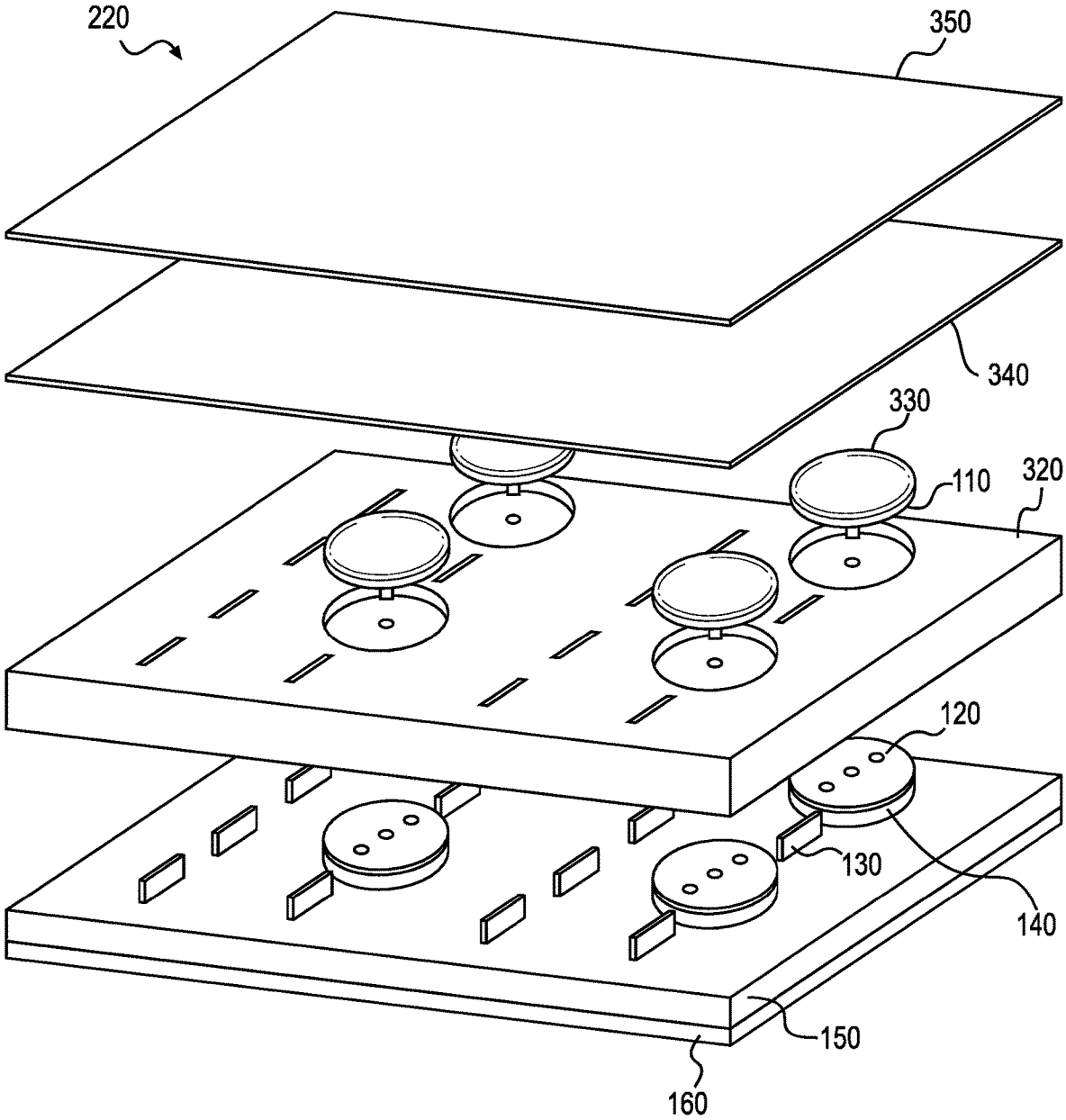
FIG. 3 is a diagram of an example antenna tile constructed in accordance with principles of the present disclosure.

FIG. 3 is a diagram of an example antenna tile 220 constructed in accordance with principles of the present disclosure. Antenna tile 220 is illustrated in FIG. 3 in exploded view for purposes of distinguishing basic features of the present concept. In the example illustrated, the principles of the present disclosure are applied to the antenna structure illustrated in FIG. 1 and like features between FIG. 3 and FIG. 1 are like-numbered. It is to be understood that, while antenna tile 220 comprises circular components of antenna elements 110, the principles of this disclosure are not limited to particular antenna component shapes.

As illustrated in FIG. 3, antenna tile 220 comprises a base structure including a supporting substrate 150 on which a ground plane may be disposed and a circuit board 160. Optionally, the substrate 150 may be planar. Distributed across the surface of this base structure are isolation wings 130, lower patches 120 and, between lower patches 120 and substrate 150, dielectric disks 140 described above with reference to FIG. 1.

In the illustrated embodiment of FIG. 3, support material 320, such as a dielectric foam, can be disposed on antenna tile 220 so as to surround the structures formed thereon. Support material 320 can replace the air surrounding the antenna structures (antenna elements 100, wings 130, etc.) in FIG. 1 between the upper patch 110 and the ground plane on which the supporting substrate 150 may be disposed. Such construction can provide mechanical reinforcement to the antenna structures as well as providing a surface on which to apply material layers described below. As indicated by the illustration, support material 320 may be applied across the base structures of antenna tile 220 prior to assembling upper patches 110 so as to fill the space between upper antenna patch 110 and lower antenna patch 120.

Each antenna element 100 may have disposed thereon a heating element 330 thus creating an array of heating elements 330 distributed across array antenna 210. In certain embodiments, heating element 330 can be applied directly to upper patch 110 of each antenna element 100. Heating elements 330 may be activated to perform deicing of the array antenna 210.

As illustrated in FIG. 3, antenna tile 220 may have one or more material layers disposed across its outermost structure, such as to protect the antenna structure from environmental elements. For example, a first such layer may be a sealing layer 340 by which, among other things, an environmental seal can be created. Sealing layer 340 may offer other benefits, such as additional structural stability and protection of the relatively delicate antenna structure against impact, when constructed from a suitable material.

An outer material layer may be applied to antenna tile 220, which may be specific to the application in which antenna 210 is used. As one example, antenna tile 220 may have an outer heat shield layer 350, which may guard against thermal shock in certain tactical applications. Other material layers may be applied as well, the composition of which may vary by application.

Figure 4:
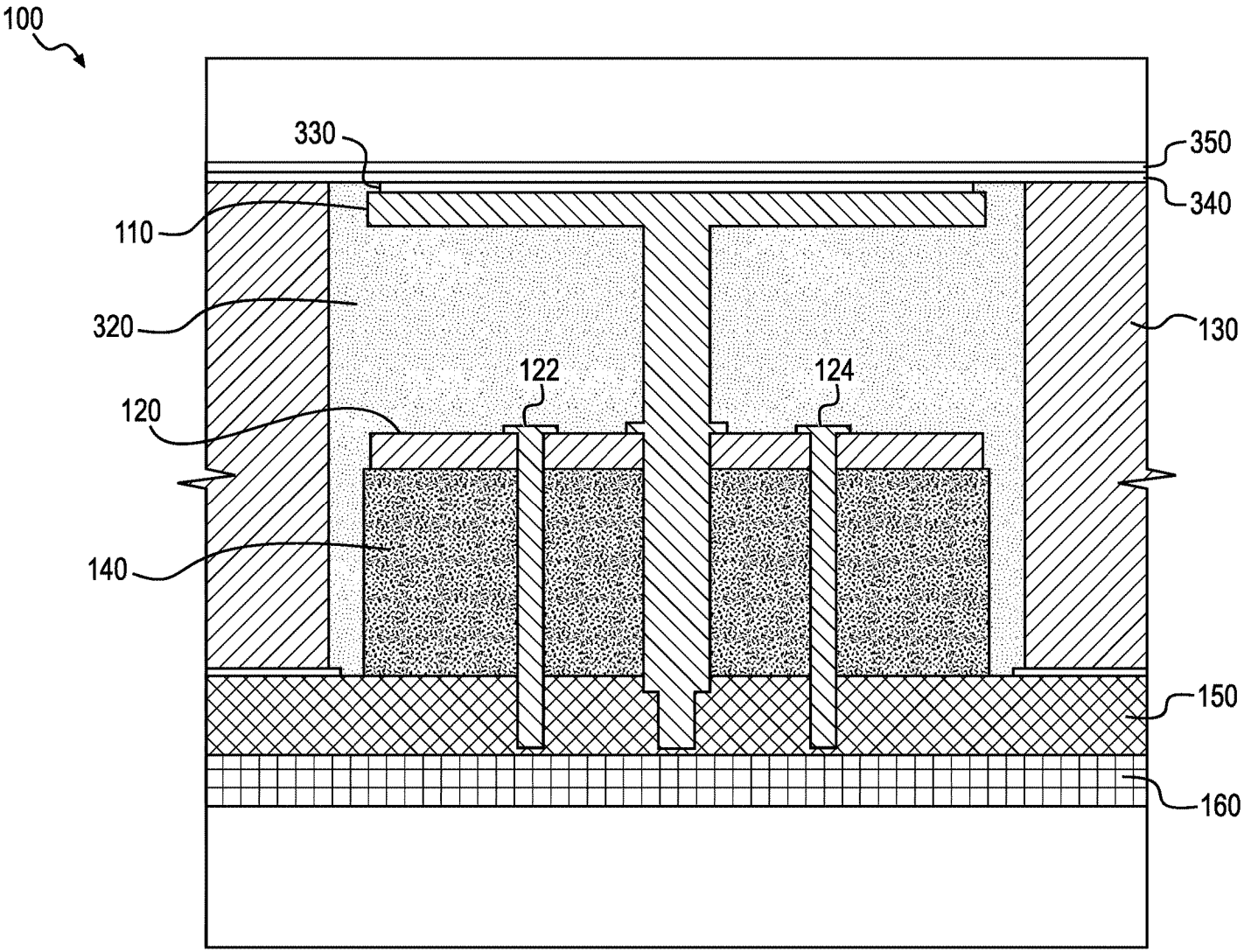
FIG. 4 is a diagram of an antenna element of the antenna tile illustrated in FIG. 3 having had principles of the present disclosure applied thereto.

FIG. 4 is a diagram of antenna element 100 of antenna tile 220 having had principles of the present disclosure applied thereto. FIG. 4 depicts the structure illustrated in exploded view in FIG. 3 in cross-sectional view to show a final assembly. The arrangement illustrated in the figure can eliminate the need for a separate radome and is referred to herein as an integrated radome.

In certain embodiments, support material 320 is a low-density (e.g., 3 lbs./ft.$^3$) dielectric foam that can be machined to tight tolerances. In other embodiments, support material 320 may be cast directly onto antenna tile 220 subsequent to assembly and prior to the application of the outer material layer(s) (i.e., sealing layer 340 and/or heat shield layer 350). Additionally, support material 320 may have a dielectric constant that is close to air, e.g., less than 1.10. Mechanically, support material 320 may have compression strength of 128 psi and shear strength of 114 psi. However, it is to be understood that the electrical properties (e.g., dielectric constant) and mechanical properties (e.g., compression and shear strengths) can vary by application. It is to be noted that support material 320 can extend between the upper patch 110 and the lower patch 120 and thus can provide support to upper patch 110 against deformation.

Sealing layer 340 may be applied, such as by spray coating, across outer structures of antenna tile 220 including the outer surface of support material 320, heating element 330, and exposed surfaces of upper patch 110. In certain embodiments, sealing layer 340 can comprise a 0.020 inch coating of an elastomeric material, such as polyurethane, that is flexible and resistant to breakage or tearing. In one example, a polyurethane sealing layer 340 may have a tear resistance of 350 pli (pounds/linear inch) and a 95+ hardness on the Shore A scale so as to be resistant to hail damage.

Optional heat shield layer 350 may be applied across the surface of sealing layer 340 such as by spray coating or casting. Heat shield layer 350 may be an ablative coating sufficient to protect antenna array 210 from thermal shock that might be encountered in a nuclear explosion. In certain embodiments, heat shield layer 350 can be 0.030 in. thick and may be constructed from a material that falls away in layers under the influence of sufficient heat.

Figure 5:
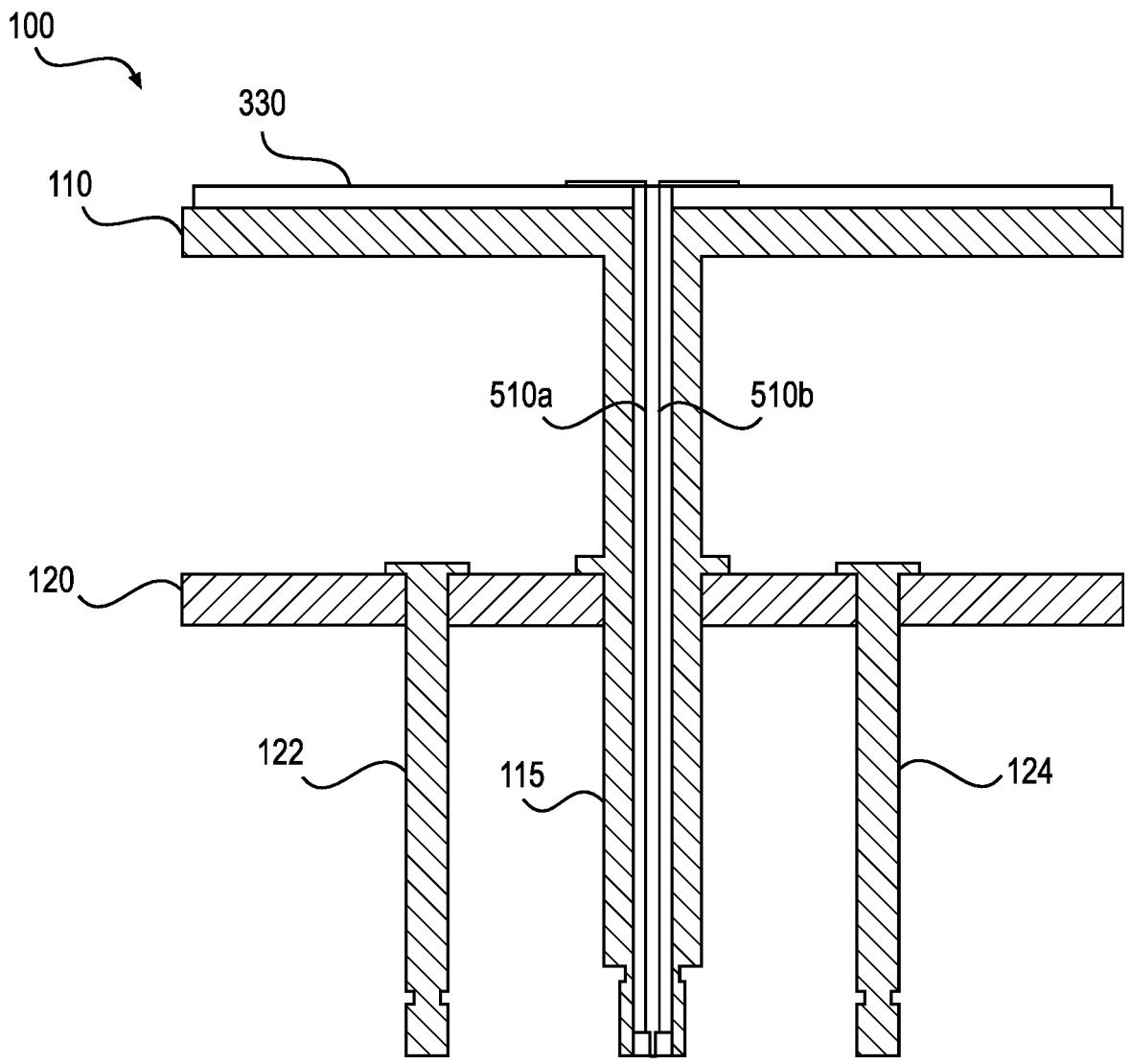
FIG. 5 is an illustration of heating element conductor routing in accordance with principles of the present disclosure.

FIG. 5 illustrates an example heating element 330, which, as illustrated in FIG. 4, can be situated between upper patch 110 and sealing layer 340. In certain embodiments, heating element 330 can comprise a resistive heater sandwiched between dielectric layers, such as polyimide film, and may be applied to upper patch 110, such as by an adhesive for a total thickness of 0.008 in. The resistive heater may deliver 3-4 W/in.$^2$ with a maximum temperature of 240° C., but other thermal levels may be embodied. Electrical operating power may be provided through a set of conductors, such as a twinaxial conductor configuration comprising conductors 510*a* and 510*b*, which may be representatively referred to herein as conductor(s) 510. It is to be understood that other conductor configurations, such as a triaxial conductor configuration, may be used in embodiments without departing from principles described herein. Conductor(s) 510, which may be beryllium copper conductors of 0.020 in. diameter and surrounded by a Teflon jacket, can be routed within the body of stem 115.

Figure 6:
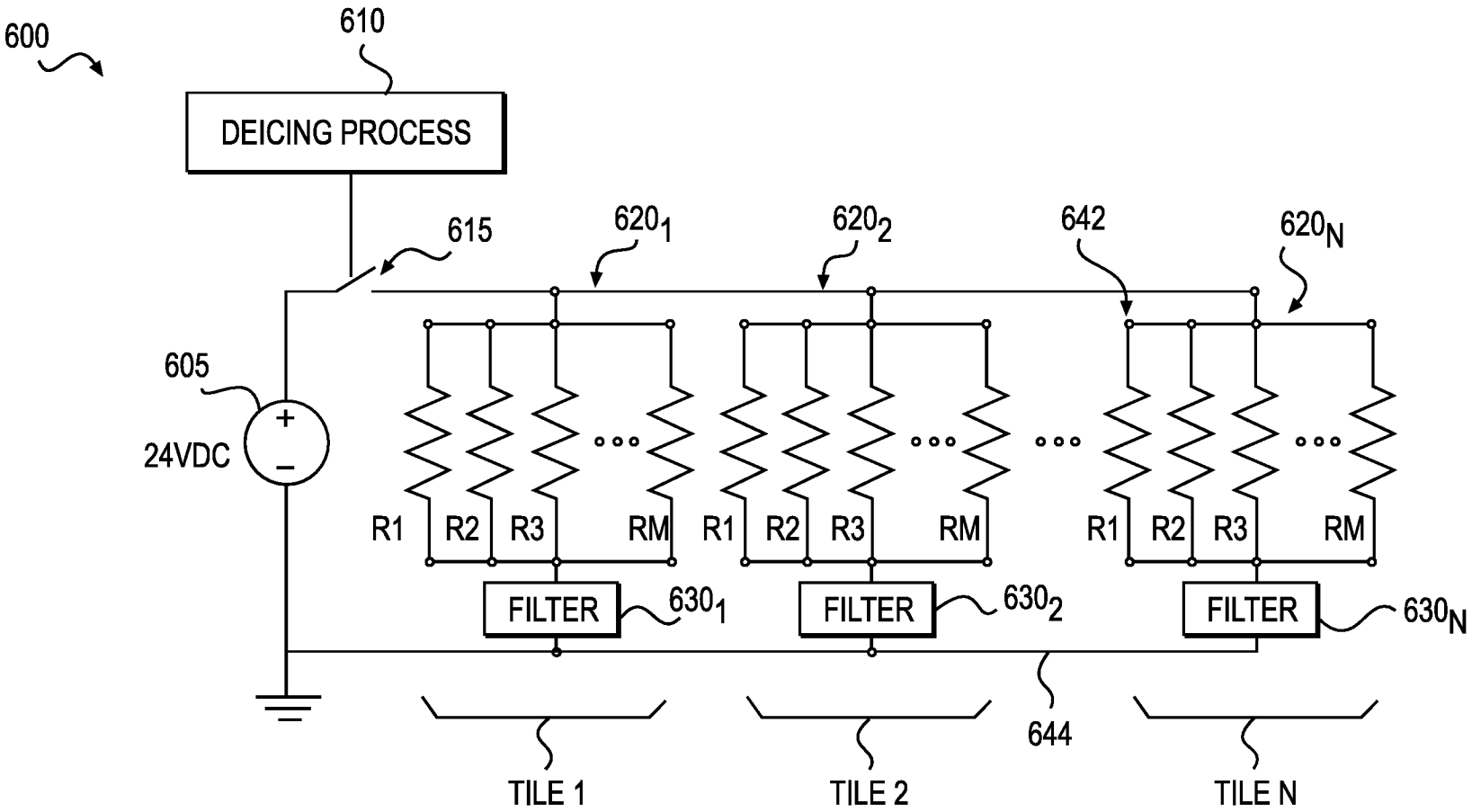
FIG. 6 is an electrical schematic diagram of an example heating circuit by which principles of the present disclosure can be embodied.

FIG. 6 is an electrical schematic diagram of an example heating circuit 600 by which principles of the present disclosure can be embodied. Heating circuit 600 is constructed for an antenna having N antenna tiles 220, each antenna tile 220 having M heating elements 330 represented in the figure by their respective resistive elements R1-RM. In certain implementations, the M heating elements 330 can correspond to M antenna elements 100 of each antenna tile 220. It is to be understood, however, that the principles of the present disclosure are not limited to a particular ratio of heating elements 330 to antenna elements 100. That is, certain implementations may apply heating elements 330 to less than all of the antenna elements 100.

Heating circuit 600 may be electrically constructed as a resistor array $\mathbf{620}_1$-$\mathbf{620}_N$, representatively referred to herein as resistor array(s) 620, of parallel resistive elements R1-RM. Each resistor array 620 can be constructed on each antenna tile 220. Resistor arrays 620 may be provided electrical power from a power source 605, which, in the illustrated embodiment, can be a 24 VDC power supply corresponding to a 24 VDC operating point of heating elements 330. In certain embodiments, such as that illustrated in FIG. 6, such provision of operating power can be selectively established through a switching mechanism 615. That is, when switching mechanism 615 is in a conducting state, 24 VDC can be provided to resistor arrays 620, and when switching mechanism 615 is in a non-conducting state, no electrical power is provided to resistor arrays 620.

The state of switching mechanism 615 may be controlled by a deicing process 610 executing on radar control circuitry 270, which may monitor environmental conditions and activate switching mechanism 615 into its conductive state when those environmental conditions are conducive to ice formation on array antenna 210. Deicing process 610 may activate switching mechanism 615 into its non-conductive state when environmental conditions indicate a low probability of icing. Principles of the present disclosure are not limited to a particular construction of switching mechanism 615, which may be implemented by a electromechanical device, such as a relay, or may be solid state, such as a transistor circuit. Moreover, principles of the present disclosure are not limited to a particular deicing process 610.

Figure 7:
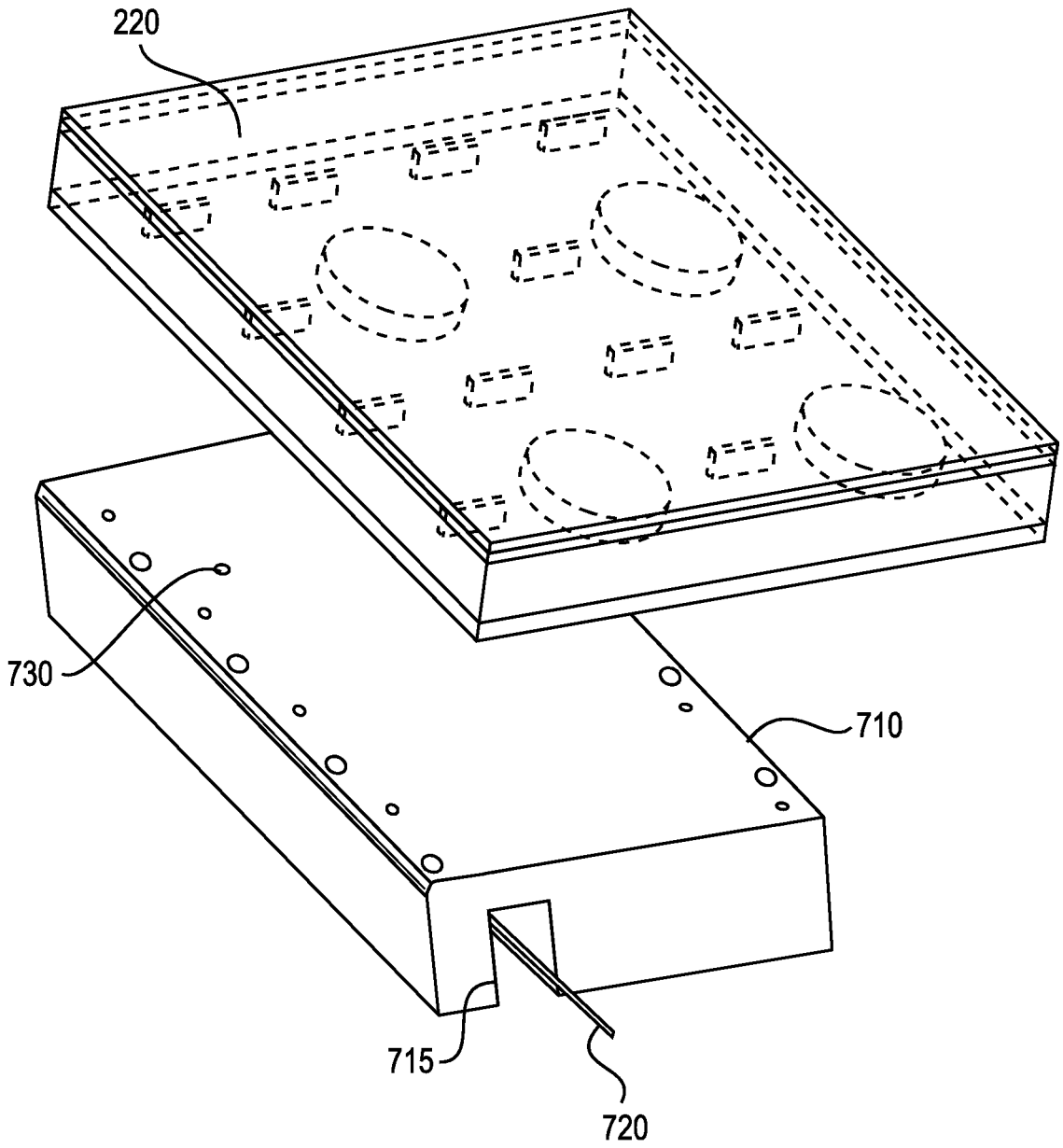
FIG. 7 is an illustration of heating circuit bus connection to antenna tiles in accordance with principles of the present disclosure.

In certain embodiments, each antenna tile 220 can have a single bus connection to feed line 642 and return line 644, and power to each heating element 100 on the antenna tile 220 can be distributed in printed wiring, such as on circuit board 160. In one example, as illustrated in FIG. 7, a bus conductor 720 can be routed among antenna tiles 220 via one or more channels 715 in support frame 710. The connection between bus conductor 720 and antenna tile 220 may be made through a suitable connector, such as a blind-mate connector 730.

Returning to FIG. 6, DC power to antenna tiles 220 may be filtered, as indicated at filters $\mathbf{630}_1$-$\mathbf{630}_N$, representatively referred to herein as filters 630. Filters 630 may be low-pass filters with suitable electromagnetic interference circuitry.

The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The present disclosure has been presented for purposes of illustration and description, but is not intended to be exhaustive or limited to the invention in the form disclosed. Many modifications and variations will be apparent to those of ordinary skill in the art without departing from the scope and spirit of the present disclosure. The embodiments were chosen and described in order to best explain the principles of the concept and practical applications, and to enable others of ordinary skill in the art to understand the concept for various embodiments with various modifications as are suited to the particular use contemplated.

The descriptions above are intended to illustrate possible implementations of the present concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the concept should therefore be determined not with reference to the description above, but with reference to the appended claims, along with their full range of equivalents.

The invention claimed is:

1. An antenna comprising:

at least one antenna element mounted on a substrate and extending normally thereto, the at least one antenna element comprising a plurality of antenna components, one of which is an upper antenna component that is furthest from the substrate;

a support material surrounding the at least one antenna element and disposed between the antenna components;

a first material layer disposed on the upper antenna component and the support material, the first material layer configured to provide an environmental seal; and a second material layer disposed on the first material layer, the second material layer configured to provide a heat shield.

2. The antenna of claim 1, wherein the support material is a dielectric foam.

3. The antenna of claim 2, wherein the dielectric foam is characterized by a dielectric constant of less than 1.10.

4. The antenna of claim 1, wherein the first material layer is polyurethane.

5. The antenna of claim 1, wherein the second material layer is ablative.

6. The antenna of claim 1 further comprising a planar heating element mechanically interposed between the upper antenna component and the first material layer.

7. The antenna of claim 1, wherein the at least one antenna element is a stacked patch antenna.

8. An array antenna comprising:

a plurality of antenna tiles arranged in an array, each of the antenna tiles including, a plurality of antenna elements distributed over a substrate and extending normally thereto, each of the antenna elements comprising respective antenna components, one of which is an upper antenna component that is furthest from the substrate, a support material surrounding the antenna elements and disposed between the antenna components, a first material layer disposed on the upper antenna components and the support material, the first material layer configured to provide an environmental seal; and a second material layer disposed on the first material layer, the second material layer configured to provide a heat shield.

9. The array antenna of claim 8, wherein the support material is a dielectric foam characterized by a dielectric constant of less than 1.10.

10. The array antenna of claim 8, wherein the first material layer is polyurethane.

11. The array antenna of claim 8 wherein the second material layer is an ablative layer.

12. The array antenna of claim 8 further comprising a heating element interposed between each of the upper antenna components and the first material layer.

13. An array antenna comprising:

a plurality of antenna tiles arranged in an array; and heating elements disposed on a set of the antenna tiles, each of the antenna tiles including, a plurality of antenna elements distributed over a substrate and extending normally thereto, each of the antenna elements comprising respective antenna components, one of which is an upper antenna component that is furthest from the substrate and another of which is at least one of the heating elements disposed on the respective-upper antenna component, the at least one of the heating elements part of the respective antenna tile from the set of the antenna tiles, a support material surrounding the antenna elements and disposed between the antenna components, a first material layer disposed on the heating elements of the respective antenna tile and the support material, the first material layer configured to provide an environmental seal, and a second material layer disposed on the first material layer, the second material layer configured to provide a heat shield.

14. The array antenna of claim 13, wherein the set of the antenna tiles includes all of the antenna tiles of the array antenna.

15. The array antenna of claim 13, wherein the support material is a dielectric foam.

16. The array antenna of claim 15, wherein the dielectric foam is characterized by a dielectric constant of less than 1.10.

17. The array antenna of claim 13, wherein the first material layer is polyurethane.

18. The array antenna of claim 13, wherein the second material layer is ablative.

19. The array antenna of claim 13 wherein each antenna tile supports a plurality of heating elements.

* * * * *